United States Patent [19]

Orsini et al.

[11] 4,075,296

[45] Feb. 21, 1978

[54] IDLE SPEED NEEDLE SCREW FOR CARBURETORS

[76] Inventors: Ronald J. Orsini, 19 Shenandoah Blvd., Coram, N.Y. 11727; Joseph Della Universita, 212 Erlanger Blvd., North Babylon, N.Y. 11703

[21] Appl. No.: 762,257

[22] Filed: Jan. 25, 1977

[51] Int. Cl.[2] ..... F02M 3/08

[52] U.S. Cl. ..... 261/41 D; 137/604; 251/DIG. 4; 261/DIG. 38; 261/121 A; 417/174

[58] Field of Search ..... 261/DIG. 38, 41 D, 121 A; 417/174, 183; 137/604, 625.24; 251/DIG. 4

[56] References Cited

U.S. PATENT DOCUMENTS

| | | | |
|---|---|---|---|
| 1,536,630 | 5/1925 | Reinecke | 251/DIG. 4 |
| 1,639,450 | 8/1927 | Bastian et al. | 251/98 |
| 1,921,779 | 8/1933 | Roberts | 251/DIG. 4 |
| 2,711,883 | 6/1955 | Reeves | 261/DIG. 38 |
| 2,763,285 | 9/1956 | Reeves | 261/DIG. 38 |
| 2,816,573 | 12/1957 | Kaddis et al. | 261/DIG. 38 |
| 2,962,269 | 11/1960 | Stanton | 261/DIG. 38 |
| 2,970,822 | 2/1961 | Ernest | 261/DIG. 38 |
| 3,166,611 | 1/1965 | Conant et al. | 261/DIG. 38 |
| 3,348,823 | 10/1967 | Roquerre | 261/DIG. 38 |
| 3,896,194 | 7/1975 | Martin | 261/DIG. 38 |

FOREIGN PATENT DOCUMENTS

| | | | |
|---|---|---|---|
| 2,434,891 | 10/1975 | Germany | 261/DIG. 38 |
| 360,563 | 11/1931 | United Kingdom | 137/604 |

*Primary Examiner*—Tim R. Miles

[57] ABSTRACT

This invention relates to an idle speed adjustment needle screw for carburetors for internal combustion motors, and more particularly to an improved tubular screw and preferably of three components, namely, a coil spring component disposed between a tubular component and a non-tubular handle component.

1 Claim, 4 Drawing Figures

IDLE SPEED NEEDLE SCREW FOR CARBURETORS

The prior art for tubular needle screws for idle speed adjustment is quite extensive and includes the following U.S. Pat. Nos. 2,816,573, 3,896,194, 3,865,907, 3,346,244, 3,313,532 and 3,077,341.

One of the disadvantages of the prior art screws is that at idle speed there is insufficient suction to vaporize the gasoline in the barrel of the carburetor, especially during cold weather. Consequently the liquid gasoline dribbles down the barrel wall in lieu of forming an explosive gaseous mixture with air. The over-all result is hard starting, flooded carburetors and waste of gasoline.

Many attempts have been made to overcome this problem but this invention is deemed to alleviate and solve this problem.

It is an object of this invention to improve the mixing of air and gasoline prior to its introduction into the carburetor.

It is another object to provide a idle speed adjustment screw operable even in locations of difficult accessibility.

Figure 1:
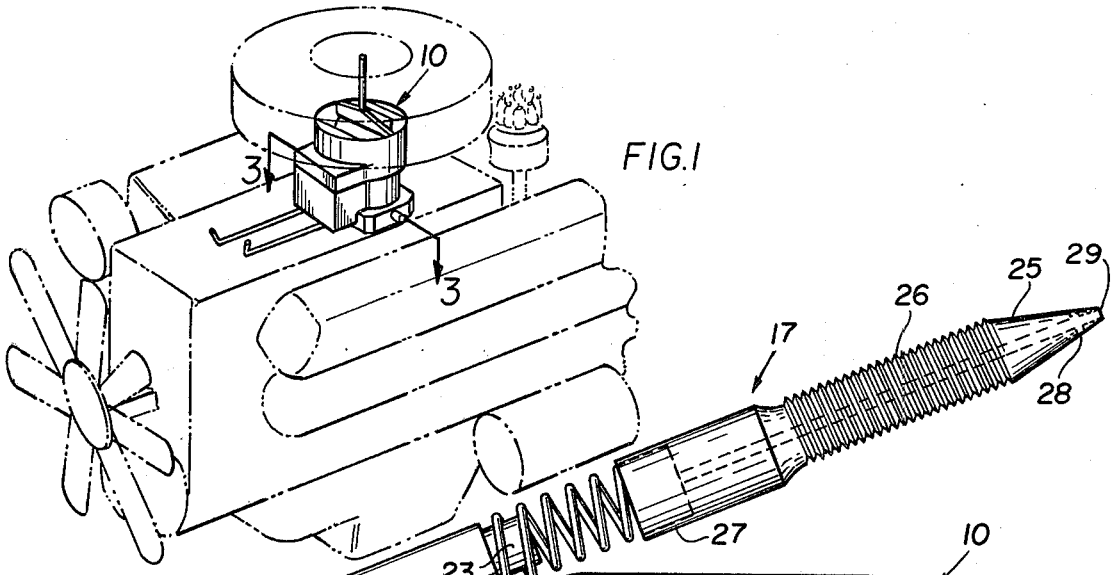
Figure 2:
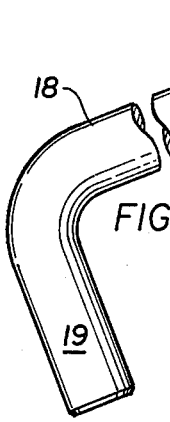
Figure 3:
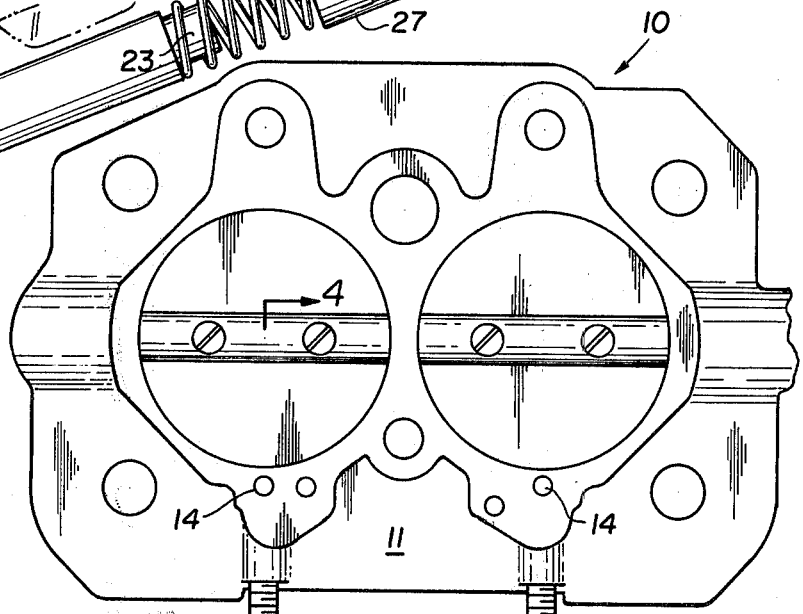
Figure 4:
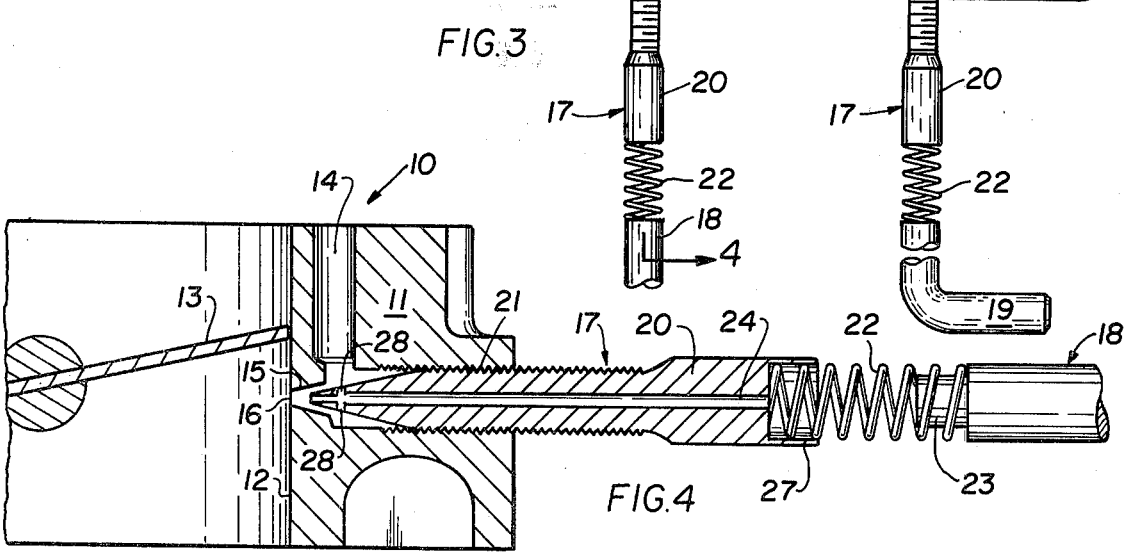

These and other objects of this invention will become readily apparent upon reading the following descriptive disclosure taken with the accompanying drawing in which FIG. 1 is an outline view of a motor having a double barrel carburetor thereon and showing the idle speed adjustment screw of this invention FIG. 2 is a side view of the idle speed screw FIG. 3 is a view taken on line 3—3 of FIG. 1 and FIG. 4 is a view taken on line 4—4 of FIG. 3

Turning now to the embodiment of this invention shown in the drawing, but other embodiments are possible, a conventional carburetor 10 having two barrels is shown disposed upon a motor in FIG. 1.

As shown in FIGS. 3 and 4, the needle nosed screw is disposed in a co-acting screw threaded aperture located in the carburetor wall 11, which aperture terminates in the interior carburetor barrel wall 12 below the butterfly valve 13.

A gasoline duct 14 is vertically disposed in the carburetor wall 11 and communicates with a horizontally disposed cone shaped aperture 15 having a circular opening 16 in the carburetor wall suitably located beneath the butter-fly valve 13.

This invention is mainly in the idle speed screw but it includes the combination with a co-acting carburetor.

As shown in FIGS. 2 and 4 the overall idle speed screw 17 comprises three components, namely an outwardly disposed handle 18 having a portion of the rod turned at an angle of ninety degrees to form a finger graspable section 19 to effect rotation as desired, a tubular exteriorally threaded component 20 adapted to engage a threaded aperture 21 in the carburetor wall 11 and a suitably long coil spring 22 to permit an angular configuration to the handle 19 for adjustment of difficulty located ports 21 in out-of-the-way places. Thus the adjustment may be made even when the three components are not in linear relationship.

The components 18, 20 and 22 are preferably press-fitted together to function as a unit, but they may be fused or welded together if desired.

The handle 18 is provided at its inner end with a circular solid stub 23 portion to engage coil 22. The needle nose component 20 is provided with an axially disposed tube 24 throughout its length, for the introduction of atmospheric air. The component 20 is also provided with a conical nose 25 and a threaded exterior wall 26 to engage the threaded aperture 21 and is further provided with circular cup portion 27 to receive coil spring 22.

We claim:

1. The combination of a carburetor having a suitable nose cone aperture in the wall of the idle system thereof and a tubular needle screw mounted therein and adapted to fit and coact with said aperture, said needle screw comprising an elongated tubular component having an exteriorly threaded cylindrical portion and a nose cone, said component having an axial passage disposed therethrough and extending to the tip of said nose cone for conducting air, and further having at least one radially disposed duct in said nose cone for conducting liquid fuel and communicating with said axial passage to produce an air-gasoline mixture within the cone prior to emerging therefrom.

* * * * *